United States Patent [19]

Dietz et al.

[11] 4,256,038

[45] Mar. 17, 1981

[54] PERFLUOROCARBON VAPOR TAGGING OF BLASTING CAP DETONATORS

[75] Inventors: Russell N. Dietz, Shoreham; Gunnar I. Senum, Patchogue, both of N.Y.

[73] Assignee: The United States of America as represented by the United States Department of Energy, Washington, D.C.

[21] Appl. No.: 9,623

[22] Filed: Feb. 6, 1979

[51] Int. Cl.[3] ..... F42B 19/04

[52] U.S. Cl. ..... 102/28 R; 149/19.91; 252/408

[58] Field of Search ..... 102/28 R; 149/19.91, 149/108.4, 109.4; 252/408

[56] References Cited

U.S. PATENT DOCUMENTS

| | | | |
|---|---|---|---|
| 3,326,731 | 6/1967 | Noddin et al. | 149/35 X |
| 3,415,865 | 12/1968 | Prager et al. | 149/35 X |
| 3,627,469 | 12/1971 | Cheng | 252/408 X |
| 3,725,671 | 4/1973 | Keister et al. | 102/28 R X |
| 3,737,349 | 6/1973 | Levenson | 252/408 X |
| 3,772,099 | 11/1973 | Ryan et al. | 252/408 X |
| 3,818,229 | 6/1974 | Long, Jr. | 252/408 X |
| 3,897,284 | 7/1975 | Livesay | 149/109.4 X |
| 3,991,680 | 11/1976 | Dietz et al. | 102/28 R |
| 4,018,635 | 4/1977 | Ryan et al. | 252/408 X |
| 4,018,884 | 4/1977 | Cleeland, Jr. et al. | 252/408 X |

OTHER PUBLICATIONS

Dietz et al., Detection of Perfluorinated Taggants in Electric Blasting Caps by Electron Capture Monitors (BNL 25050).

Senum et al., Vapor Tagging of Electric Blasting Caps with Perfluorinated Compound (BNL 25051).

Dietz et al., Evaluation of Detection-Monitors (BNL 24959).

Various Monthly Contract Reports & Senate Testimony Reports.

*Primary Examiner*—Peter A. Nelson

*Attorney, Agent, or Firm*—Leonard Belkin; Richard G. Besha; James E. Denny

[57] ABSTRACT

A plug for a blasting cap is made of an elastomer in which is dissolved a perfluorocarbon. The perfluorocarbon is released as a vapor into the ambient over a long period of time to serve as a detectable taggant.

8 Claims, 5 Drawing Figures

PERFLUOROCARBON VAPOR TAGGING OF BLASTING CAP DETONATORS

The invention described herein was made in the course of or under contract with the United States Department of Energy.

This invention is concerned with blasting cap taggants and more particularly concerns blasting caps employing perfluorocarbons as vapor taggants.

BACKGROUND OF THE INVENTION

It has been proposed heretofore to tag an explosive by enclosing within a blasting cap a source of sulfur hexafluoride ($SF_6$) vapor absorbed in a fluoropolymer. Such a taggant is described in U.S. Pat. No. 3,991,680 issued Nov. 16, 1976 to R. N. Dietz et al.

While this technique avoids the prior reliance upon physical searches, X-Rays, and dogs trained to sniff out the presence of certain types of explosive materials, its usefulness has been limited by major disadvantages. Sulfur hexafluoride vapor is present in ambient air in readily detectable amounts ($0.5 \pm 0.1$ parts per trillion). It is used to a large extent by commercial and industrial processes. Thus electronic detectors or "sniffers" used to detect the presence of $SF_6$ often produce misleading indications of the presence of explosives, when none are present. Furthermore, the high background concentrations of $SF_6$ might limit the detection of explosives containing this taggant in certain detection situations. Secondly, the high intrinsic vapor pressure of $SF_6$ (343 psia at 25° C.) interfers with the delayed timing mechanisms of blasting cap detonators, thus precluding the use of $SF_6$ as a vapor taggant in timed blasting cap detonators.

SUMMARY OF THE PRESENT INVENTION

The present invention overcomes the disadvantages of using $SF_6$ as a taggant, by providing a vapor emitting taggant which is not present in ambient air to any readily detectable degree (less than 0.01 parts per trillion) nor used by commercial or industrial processes to a large extent and by providing a taggant which has a low intrinsic vapor pressure (less than 10 psia at 25° C.)

The invention is applied by dissolving a perfluorocarbon in compatible elastomers which are used as plugs to seal blasting caps. Since most illicit explosive devices are electrically detonated by blasting caps, the vapor tagging of such blasting caps makes possible reliable predetonation detection.

These and other objects and many of the attendant advantages of this invention will be readily appreciated as the same becomes better understood by reference to the following detailed description when considered in connection with accompanying drawing.

DESCRIPTION OF THE PREFERRED EMBODIMENT

Figure 1:
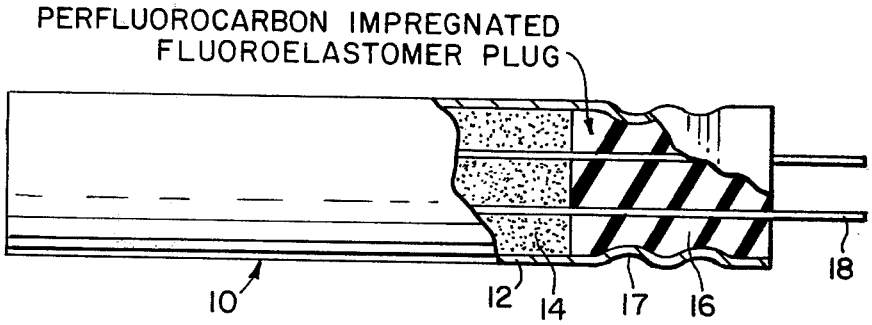
FIG. 1 is an elevation view, in partial section illustrating an embodiment of the invention.

The figure shows a detonator device or blasting cap generally designated as reference numeral 10, of conventional construction consisting of a shell 12 containing an explosive or detonating material 14. An elastomeric plug 16 is held in place at one end of the shell 12 by crimping 17. A pair of electrical leads 18 extend axially through the plug 16 to the detonating material 14, to permit electric detonation of the device 10.

The elastomeric plug 16 contains a perfluorocarbon which releases vapor that can be readily detected by detectors specifically sensitive to these taggants. Examples of perfluorocarbon vapor taggants which may be used successfully are perfluorocycloalkanes, such as perfluorodimethylcyclobutane (PDCB), perfluoromethylcyclohexane (PMCH), and perfluorodimethylcyclohexane (PDCH); perfluoroaromatics such as hexafluorobenzene (HFB), octafluorotoluene (OFT), decafluorobiphenyl (DFBP), decafluoroxylene (DFX), octafluoronaphthalene (OFN), and pentafluoropyridene (PFP), perfluoroalkanes such as perfluorohexane (PFH), perfluoropentane (PFPT), and perfluorooctane (PFO), and perfluorocycloalkenes such as decafluorocyclohexene (DFCH) and octafluorocyclopentene (OFCP). Examples of elastomers which are compatible with several of these taggants are copolymers of vinylidene fluoride and hexafluoropropylene. These are fluoroelastomers which are commercially available from respectively, Dupont under the trademark "Viton" and Minnesota Mining and Manufacturing Company (3M) under the trademark "Fluorel". Several of these taggants are compatible with elastomers presently used in electric blasting cap detonators, i.e., Buna N elastomers as presently used by DuPont, an unspecified elastomer as presently used by Atlas, and Kraton an injection moldable elastomer presently used by Hercules.

The perfluorocarbon taggants are dissolved in a compatible elastomer which are then used as the plugs 16 for the caps 10. The impregnation of the perfluorocarbon taggant in the elastomer is accomplished as follows:

For the perfluorocycloalkane, perfluoroalkane and perfluorocycloalkene taggants, the elastomer is immersed in the taggant at room temperature for a period of two weeks. The impregnation is complete when the elastomer has obtained the maximum solubility for the taggant which is 5–10% by weight for these taggants. This process can be accelerated by increasing the immersion temperature.

For the fluoroaromatic taggants, the taggant is impregnated by immersing the elastomer in a solution consisting of the taggant in an inert solvent (either hexane or cyclohexane) for a period up to fourteen days at room temperature (25° C.).

The degree of taggant impregnation in the elastomer is controlled by varying the taggant mole fraction in the solution depending on the maximum solubility of the taggant in the elastomer. The mole fraction is set at the ratio of the desired solubility to the maximum solubility.

This technique assures uniform taggant impregnation of the elastomer which is required for a long taggant emission lifetime. Table 1 tabulates the maximum solubility of the various perfluorocarbons in the aforementioned elastomers. A compatible elastomer for the various taggants is an elastomer with at least 5% solubility for that taggant. Optimal taggant impregnation is in the 5–10% range.

The perfluorocarbon impregnated blasting cap plug 16 releases the vapor taggant at a predictable emission rate, ideally 1 nanoliter per minute ($1\times10^{-9}$ liters per minute) at one year after manufacturing. Predicted perfluorocarbon taggant emission rates are tabulated in Table 2 as derived from experimental data.

Compared to other taggants the perfluorocarbon taggants are unique, assuring that the detected taggant vapor has been emitted from a tagged blasting cap and not from any commercial or industrial source.

The perfluorocarbon taggants have a low ambient background (less than $1\times10^{-14}$ p/p) allowing for the detection of the taggants in most situations. There is comparatively negligible interference with the detonation timing of the blasting cap 10 since the perfluorocarbon taggants have a low vapor pressure at room temperature (less than 1 atmosphere). These taggants have a minimum effect on the mechanical and physical properties of the elastomeric plug 16, thus assuring an effective blasting cap seal. The perfluorocarbon taggant-/elastomer plug combination can be chosen so as to assure a long useful taggant emission lifetime (greater than 5 years) with emission rates allowing detection in most situations during that time.

The expected perfluorocarbon taggant concentration in certain detection situations can be calculated based on the emission rates expected from a perfluorocarbon tagged blasting cap detonator with a taggant emission lifetime greater than 5 years and are tabulated in Table 3. The detection situations that were considered was a tagged cap placed within an attache case, a tagged cap within an attache case placed in a meeting room, placed in a plane and placed in a building. The perfluorocarbon taggant concentrations inside the attache case are of the order of parts per $10^9$; the meeting room and plane, parts per $10^{14}$ and inside the building parts per $10^{16}$. The detection limits of the perfluorocarbon taggant monitors are presented in Table 4, showing that it is presently possible to detect an attache case containing a tagged cap with a real time continuous portable monitor using a suitable attache case/suitcase sampling system tolerating a sampling dilution up to a factor of 1000. Similarly it is expected that a concentrating portable real-time continuous monitor will be able to detect the perfluorocarbon taggant in the meeting room and plane detection situations. The detection of the taggant in the building will require a non-real-time concentrating monitor. It should be understood that the foregoing relates to only a limited number of preferred embodiments of the invention, which have been by way of example only and that it is intended to cover all changes and modifications of the example of the invention herein chosen for the purposes of the disclosure, which do not constitute departures from the spirit and scope of the invention.

TABLE 1

Solubility of Various Perfluorocarbons in Various Elastomers in % (by weight)

| Perfluorocarbon | DuPont Buna N | Atlas Elastomer | Hercules Kraton | Viton/ Fluorel |
|---|---|---|---|---|
| OFN | 60.3 | 25.6 | 182.6 | 107.2 |
| HFB | 22.0 | 28.6 | 26.4 | 85.9 |
| OFT | 5.7 | 10.3 | n | 60.5 |
| DFBP | 11.2 | 27.8 | n | 60.1 |
| PFX | 8.0 | 6.9 | n | 7.3 |
| PFP | 40.9 | 11.5 | 3.0 | 139.0 |

TABLE 1-continued

Solubility of Various Perfluorocarbons in Various Elastomers in % (by weight)

| Perfluorocarbon | DuPont Buna N | Atlas Elastomer | Hercules Kraton | Viton/ Fluorel |
|---|---|---|---|---|
| PDCB | n | n | n | 8.9 |
| PMCH | n | 1.7 | n | 7.6 |
| PDCH | n | 0.6 | n | 7.9 |
| DFCH | n | 6.1 | n | 20.0 |
| OFCP | n | 6.6 | n | 24.3 |

n = negligible solubility

TABLE 2

Perfluorocarbon Taggant Emission Rates For Various Taggant/Elastomer Combinations

| Taggant/Elastomer | Emission Rate 1 Year (nl/min) | Emission Rate 4 Years (nl/min) |
|---|---|---|
| OFN/DuPont Buna | 0.92 | 0.46 |
| DFBP/DuPont Buna | 1.40 | 0.70 |
| OFCP/Atlas Rubber | 2.20 | 1.10 |
| DFBP/Atlas Rubber | 1.90 | 0.95 |
| PFP/Viton-Fluorel | 3.00 | 1.50 |
| OFCP/Viton-Fluorel | 0.62 | 0.31 |
| DFCH/Viton-Fluorel | 0.34 | 0.17 |
| DFX/Viton-Fluorel | 0.59 | 0.30 |
| HFB/Viton-Fluorel | 0.81 | 0.41 |
| OFT/Viton-Fluorel | 0.63 | 0.32 |

TABLE 3

Expected Scenario Taggant Concentrations (One hour after placement of tagged blasting cap)

| Tagged Cap Age | | Perfluorocarbon Taggant Concentration | | | |
|---|---|---|---|---|---|
| Years | Rate[a] | Attache Case pp $10^9$ | Meeting Room[b] pp $10^{14}$ | Plane[c] pp $10^{14}$ | Building[d] pp $10^{16}$ |
| 0.5 | 1.29 | 2.44 | 5.28 | 2.60 | 1.20 |
| 1 | 0.919 | 1.74 | 3.76 | 1.85 | 0.86 |
| 2 | 0.649 | 1.23 | 2.65 | 1.31 | 0.60 |
| 5 | 0.410 | 0.78 | 1.68 | 0.83 | 0.38 |
| 10 | 0.291 | 0.55 | 1.19 | 0.59 | 0.27 |

[a]Typical rate in $10^{-9}$ l/min from tagged caps
[b]40 ft × 50 ft; Air exchange every 57 min
[c]Type 707 or DC-8; 10,000 $ft^3$ vol.; Air exchange every 10 min; EBC in suitcase for 1 hour, but in plane only 10 min
[d]200 ft × 400 ft × 100 ft; Air exchange every 40 min

TABLE 4

Perfluorocarbon Taggant Electron Capture Detection Monitors

| | Instrument | Detection Limit Present | Detection Limit Future |
|---|---|---|---|
| 1. | Continuous (Real Time) (portable; any perfluorocarbon taggant) | 2 pp $10^{12}$ | 2 pp $10^{13}$ |
| 2. | Continuous Concentrating (portable; any perfluorocarbon taggant) | — | 2 pp $10^{15}$ |
| 3. | Sequential Conc. GC | | |
| | . with packed column (portable; speciates) | 1 pp $10^{13}$ | 5 pp $10^{16}$ |
| | . with capillary column (semi-portable; speciates | — | 1 pp $10^{17}$ |
| 4. | Laboratory Conc. GC | | |
| | . with packed column (non-portable; speciates) | 1 pp $10^{16}$ | 5 pp $10^{17}$ |
| | . with capillary column (non-portable; speciates) | — | 1 pp $10^{18}$ |

EXPERIMENTAL EXAMPLE I

Laboratory Chromatograph System

A laboratory chromatograph basically consists of a means for introducing the sample to be analyzed just ahead of, typically, a long tubular column packed with a solid or liquid supported absorbent phase. The column serves to separate the constituents to be measured, eluting them at discrete times-their retention times-prior to entering the detector, in this case an electron capture detector (ECD). One of the requirements necessary for the successful detection of the PFT (perfluorocarbon taggant) in addition to its high sensitivity to electron capture detectors (typically 1 pp $10^{12}$), is the ability to be able to uniquely distinguish the compound from among possibly many other interferences.

The ambient air contains many electronegative compounds, both halocarbons as well as several inorganic gases. More than 20 halocarbon compounds have been identified with concentrations ranging from about 5 pp $10^{12}$ (Freon 21, $CH_3I$, $C_2Cl_6$, $C_2Cl_6$, $C_2H_4Br_2$) up to about 100 to 700 pp $10^{12}$ (Freon 12, Freon 11, $CCl_4$ $CH_3CCl_3$, $CH_3Cl$) all of which have varying, but reasonably significant, response to an ECD. On the other hand, the expected concentration of taggant, depending on the explosive sampling scenario, may range from 10 pp $10^{12}$ at the highest to as low as 0.1 pp $10^{15}$ or less, that is, possibly 7 orders of magnitude below the combined concentration of all atmospheric halocarbons.

Figure 2:
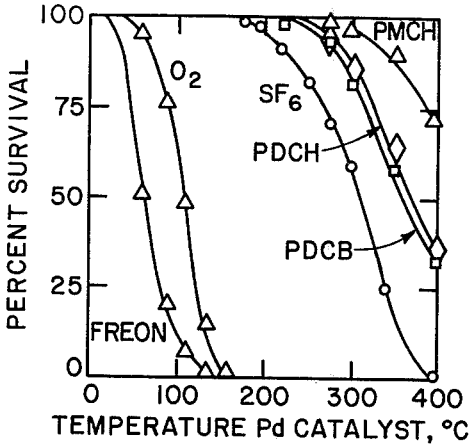
FIG. 2 is a graph showing the temperature stability of various taggants in the presence of a catalyst.

Since column separation alone could not possibly hope to resolve such trace quantities of taggant from the much larger mix of ambient halocarbons, an additional separation factor was employed. A small bed ($\frac{1}{8}$-inch lumen by 1-inch long) of 5% palladium supported on 5A molecular sieve in the presence of a few percent of a reducing gas, $CH_4$ or $H_2$, was found to quantitatively catalyze the reduction of the halocarbons—provided most of the oxygen was previously physically separated by on-line sample trapping. The catalyst bed temperature could be tuned to a temperature of about 175° C., which, as shown in FIG. 2, did not affect the survival of the taggants, but did efficiently and completely remove any trace oxygen and all the halocarbon compounds. All the potentially interfering compounds were catalytically reactive at temperatures corresponding to the freon curve or lower. The products of the destruction, traces of water and halogen acid vapors, were removed by an in-line permeation dryer.

The taggants survived the reducing atmosphere in the catalyst bed because of the inherent chemical stability of fully fluorinated (perfluorinated) organic or inorganic compounds. The most stable taggant shown in FIG. 2 was perfluoromonomethylcyclohexane, PMCH, followed by perfluorodimethylcyclohexane, PDCH, and perfluorodimethylcyclobutane, PDCB.

Figure 3:
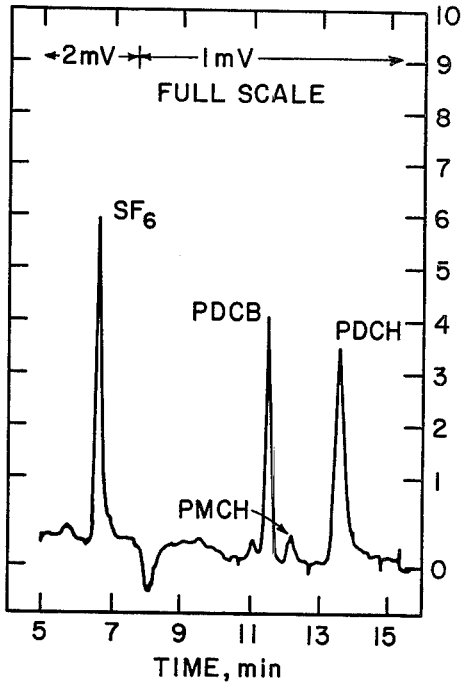
FIG. 3 is a chromatogram of a prepared air standard.

With the combination of catalytic reactor and chromatographic separation, the laboratory instrument has been used to analyze 40 ml air samples for the three PFTs and $SF_6$. A typical chromatogram of a prepared air standard is shown in FIG. 3. The limit of detection of the PFTs from that size sample was about 1 pp $10^{14}$ at a S/N of 2.

EXPERIMENTAL EXAMPLE II

Preconcentration Samplers

Figure 4:
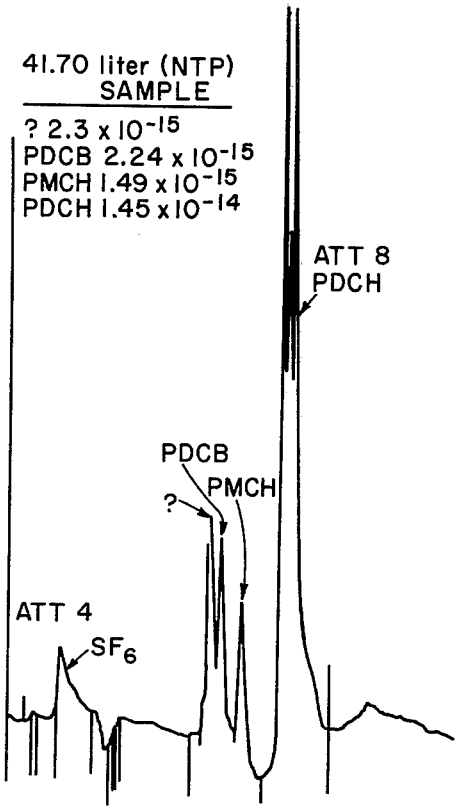
FIG. 4 is a chromatogram of a recovered sample.

In order to measure still lower concentrations of PFTs in the atmosphere, several instruments have been and are being developed to concentrate the trace amount of taggant vapor in a large volume of air onto a relatively small amount of solid adsorbent for subsequent thermal recovery and analysis. A preliminary indication of the capability of this approach was demonstrated by collecting 41.7 liters of rural (away from any possible local sources) ambient air on just 50 mg of cocoanut charcoal. The chromatogram of the recovered sample, shown in FIG. 4, indicated that the clean air background concentration of PDCH was 1.45 pp $10^{14}$ (includes about 15% that was recovered from a subsequent heating and analysis) and 1.49 pp $10^{15}$ for PMCH.

Worldwide production of PDCH indicated that a background concentration of about 1.8 pp $10^{14}$ PDCH should presently exist. Since PMCH has been an impurity in the production of PDCH, present at about 10%, the agreement between measured and expected levels was quite good. The value of PDCB may have been contaminated with an unknown constituent as well as the PDCB, since its level in the atmosphere, again based on production figures, was expected to be about 1 pp $10^{16}$. $SF_6$ was not measured, in part because it is not efficiently retained by the charcoal and in part because it is reactive with the charcoal during the thermal recovery.

As a result of subsequent studies, the limit of detection of PFTs from a 4 liter concentrated sample has been determined to be about 1 pp $10^{16}$ at a S/N of 2.

EXPERIMENTAL EXAMPLE III

Sequential Concentrating Chromatograph

Based on a combination of adsorption collection followed by on-line desorption and analysis, a two-trap sequential chromatograph was designed and developed in England and evaluated and tested in some field measurements in the U.S. For about a 5-minute period, while one adsorption trap was being utilized to remove the PFTs, the other was being analyzed for its contents. Although the limit of detection in these experiments was only 1 pp $10^{13}$, the method has the potential for significant improvement.

EXPERIMENTAL EXAMPLE IV

Continuous Monitor

A portable monitor was developed and field tested in 1972, utilizing a procedure called frontal chromatography to continuously analyze for $SF_6$ for up to 45 seconds before oxygen eluted from the column and terminated the scan. Since that time numerous improvements were made in the design, increasing the measurement time for up to $3\frac{1}{2}$ minutes of continuous output at a sensitivity of 1 pp $10^{12}$, but the method was only specific for $SF_6$.

Figure 5:
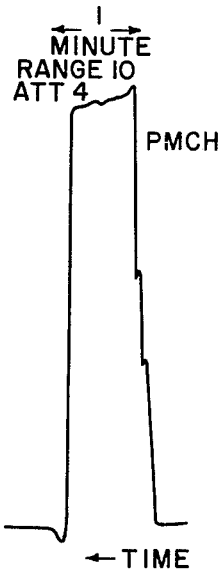
FIG. 5 shows the response of a continuous monitor to a particular taggant.

To provide a truly continuous monitor and to extend the capability to the PFTs, a new instrument was devised. By utilizing the same type of catalyst bed as described for the laboratory chromatograph system, ambient air was continuously mixed with half as much hydrogen and pumped through the reactive bed. The oxygen in the air was converted to water (steam) and the potentially interfering freon compounds were again converted to their respective acids. Using either a thermoelectrically cooled condenser or a permeation dryer, the water and halogen acids content are reduced to a level sufficiently low to allow the gas stream to pass directly into the detector, where the surviving PFTs and $SF_6$ in the remaining $N_2$ are measured. A typical scan with the instrument, using a tagged EBC in the inlet tubing at the pump, results in a square wave signal. The PMCH-tagged EBC for the scan in FIG. 5 gave an effective concentration of about 1.2 pp $10^9$.

Brookhaven has built and field tested two of these continuous monitors, one of which was utilized in the conveyor belt suitcase screening tests. One instrument was flown successfully in field tracer experiments in Indiana in October 1977 and two were used in recent tracer releases at a coal fired power plant in Tennessee during August 1978, attesting to their field worthiness.

We claim:

1. In an explosive device comprising an electrical detonator having a shell containing detonating material, and means for sealing said shell, the improvement comprising:

a mass of material containing a perfluorocarbon which is released over a period of time as a vapor taggant from said mass.

2. An explosive device as defined in claim 1, wherein said mass of material has the form of a plug installed within said shell.

3. An explosive device as defined in claim 2, wherein said cylindrical plug is flexible so that said plug is crimped into place in said shell.

4. An explosive device as defined in claim 1, wherein said mass of material is an elastomer compatible within said perfluorocarbon.

5. An explosive device as defined in claim 4, wherein said perfluorocarbon is dissolved in said elastomer.

6. An explosive device as defined in claim 5 wherein said perfluorocarbon is one selected from the group of perfluorokycloalkanes perfluoroaromatics; perfluoroalkanes and perfluorocycloalkenes.

7. An explosive device as defined in claim 2, wherein said elastomer is an elastomer with at least 5% solubility for the perfluorocarbon taggants.

8. An explosive device as defined in claim 7 wherein the elastomer is a copolymer of vinylidene flouride and hexafluoropropylene.

* * * * *